US008936500B1

(12) United States Patent
Ebrahimi

(10) Patent No.: US 8,936,500 B1
(45) Date of Patent: Jan. 20, 2015

(54) DUAL SECTION PADDLEBOARD

(71) Applicant: Shaine Shahin Ebrahimi, Carbondale, CO (US)

(72) Inventor: Shaine Shahin Ebrahimi, Carbondale, CO (US)

( * ) Notice: Subject to any disclaimer, the term of this patent is extended or adjusted under 35 U.S.C. 154(b) by 0 days.

(21) Appl. No.: 13/929,714

(22) Filed: Jun. 27, 2013

(51) Int. Cl.
*B63B 35/83* (2006.01)
*B63B 35/79* (2006.01)

(52) U.S. Cl.
CPC ..... *B63B 35/7916* (2013.01)
USPC ..... 441/76

(58) Field of Classification Search
USPC ..... 441/66, 76, 77
IPC ..... B63B 35/83
See application file for complete search history.

(56) References Cited

U.S. PATENT DOCUMENTS

| | | | | | |
|---|---|---|---|---|---|
| 1,768,395 | A * | 6/1930 | Brylka | ..... | 441/76 |
| 3,455,571 | A * | 7/1969 | Giancarlo et al. | ..... | 280/18 |
| 3,621,500 | A * | 11/1971 | Senghas | ..... | 441/77 |
| 4,037,280 | A * | 7/1977 | Klepsch | ..... | 441/76 |
| 4,129,912 | A * | 12/1978 | Robinson | ..... | 441/76 |
| 7,048,282 | B2 * | 5/2006 | Steiner et al. | ..... | 280/18 |

* cited by examiner

*Primary Examiner* — Stephen Avila
(74) *Attorney, Agent, or Firm* — Plager Schack LLP

(57) ABSTRACT

A dual section paddle board is configured to be stable in water which is shallow without fouling vegetation or hitting rocks. The dual section paddle board includes two board sections that are symmetrical along a single edge of each section to increase stability while paddle boarding. A connector joins the two board sections proximate one another permitting balance shifting that further increases stability. Each board section is made from a buoyant material in order to maintain buoyancy while avoiding damage to the board section.

4 Claims, 4 Drawing Sheets

DUAL SECTION PADDLEBOARD

RELATED APPLICATION

This application claims priority to provisional patent application U.S. Ser. No. 61/665,063 filed on Jun. 27, 2012, the entire contents of which is herein incorporated by reference.

BACKGROUND

The embodiments herein relate generally to watercraft operated by a single user.

Prior to the disclosed invention, balancing oneself on a paddle board was challenging because water moving beneath the paddle board caused the paddle board to move at angles that were difficult for a user to anticipate. The prior art includes WIPO Publication 1990/014987 A1 filed by Nayes.

Nayes teaches a water walking device utilizing a pair of buoyant hulls. The hulls are identically shaped and lack a shape that naturally works with walking, accordingly they are unstable. Nayes solves this problem in two ways: first by installing stabilizing fins on the bottom of each hull and second by having the user insert one's foot into a recessed cavity in each hull to lower the center of gravity and therefore create greater stability.

This creates at least two problems solved by the present invention, first is falling over, if one loses balance on Nayes one is certainly inverted and being inverted with the only buoyant point being one's feet is extraordinarily dangerous when used in deeper water. Further, the stabilizing fins, while perhaps well intentioned are likely to get snagged in vegetation in shallower water. Embodiments of the present invention solve this problem by first, stabilizing the hulls in a more efficient manner which does not require tethering to a user's feet or stabilizing fins.

SUMMARY

A dual section paddle board is configured to be stable in water which is shallow without fouling vegetation or hitting rocks. The dual section paddle board includes two board sections that are symmetrical along a single edge of each section to increase stability while paddle boarding. A connector joins the two board sections proximate one another permitting balance shifting that further increases stability. Each board section is made from a buoyant material in order to maintain buoyancy while avoiding damage to the board section.

The connector can vary depending on the embodiment. For instance, the connector can be an air bladder affixed to the buoyant material of each board section. The air bladder is filled with compressed air making it rigid. The connector can be a first air bladder affixed to buoyant material of each board section and the two board sections can be further attached to a second air bladder to allow greater flexibility to transfer weight without capsizing the dual section paddle board. The connector can be a pair of fasteners mechanically coupled to a tether such that the two board sections are sufficiently separated to provide stability in rougher water or close together to provide stability in calm water.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
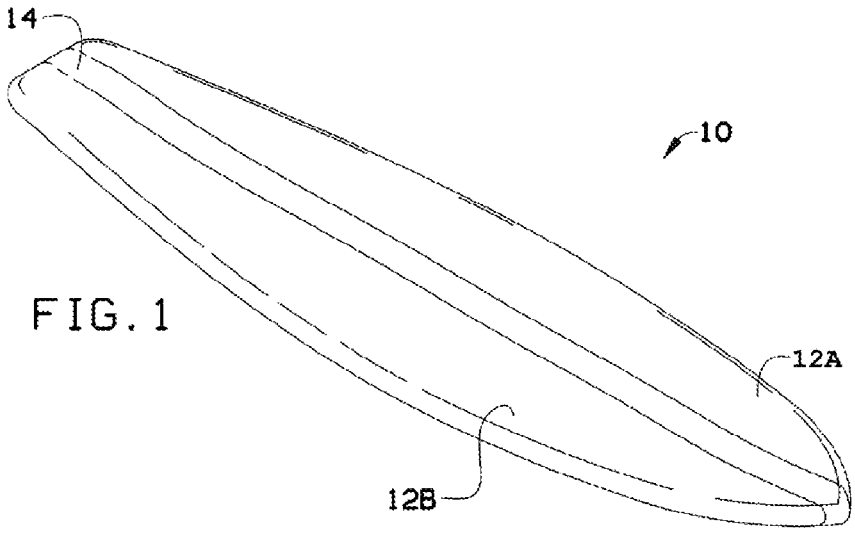
FIG. 1 is a perspective view of the tri-chamber inflatable paddleboard embodiment.
Figure 2:
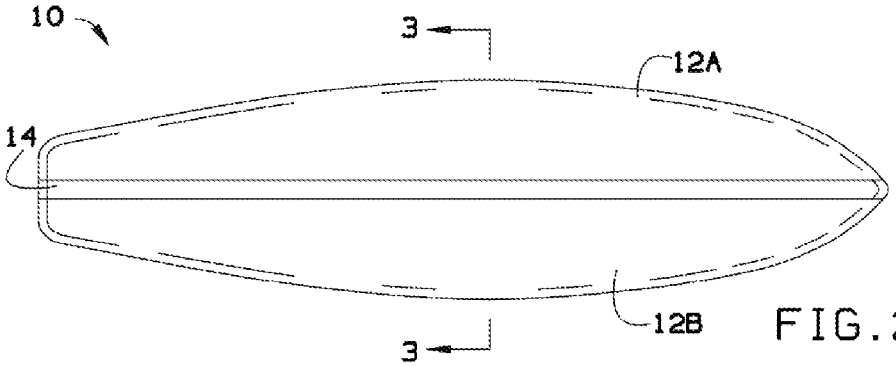
FIG. 2 is a top view of the tri-chamber inflatable paddleboard embodiment.

By way of example, and referring to FIG. 1 and FIG. 2, tri-chamber arrangement 10 of the present system comprises first board section 12A mechanically coupled to air bladder 14. Air bladder 14 is further mechanically coupled to second board section 12B. Air bladder 14 can be deflated to free up the two board sections 12 to move. This allows for an essentially parallel top surface on top of tri-chamber arrangement 10 which can provide some minor flexibility for weight shifting that can be useful in relatively calm shallow water.

Unlike Nayes which utilizes two identical hulls, embodiments of the present invention utilize two sections of a board that are symmetrical along a single edge of each section. This causes a greater mass of material to be in the instep of each board which facilitates balance while paddle boarding.

Figure 3:
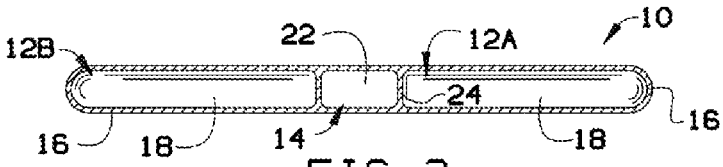
FIG. 3 is a section view of the tri-chamber inflatable paddleboard embodiment along line 3-3 in FIG. 2.

Turning to FIG. 3, each board section 12 should be buoyant and can be made in any known manner, though the following construction is exemplary. Board section 12 comprises buoyant layer 18 which can maintain buoyancy covered by protective layer 16. In some embodiments, buoyant layer 18 is made a buoyant material such as plastic, fiberglass, foam such as closed-cell extruded polystyrene foam such as the one sold under the trademark STYROFOAM®. In some embodiments, protective layer 16 is made from a fiber reinforced polymer made of a plastic matrix reinforced by fine fibers of glass commonly called "fiberglass." However, any rigid material is likely to be effective.

Air bladder 14 air filled with compressed air 22 to ensure rigidity. In some embodiments, air bladder 14 can be made of neoprene which can be affixed to protective layer 16 in a known manner.

Figure 4:
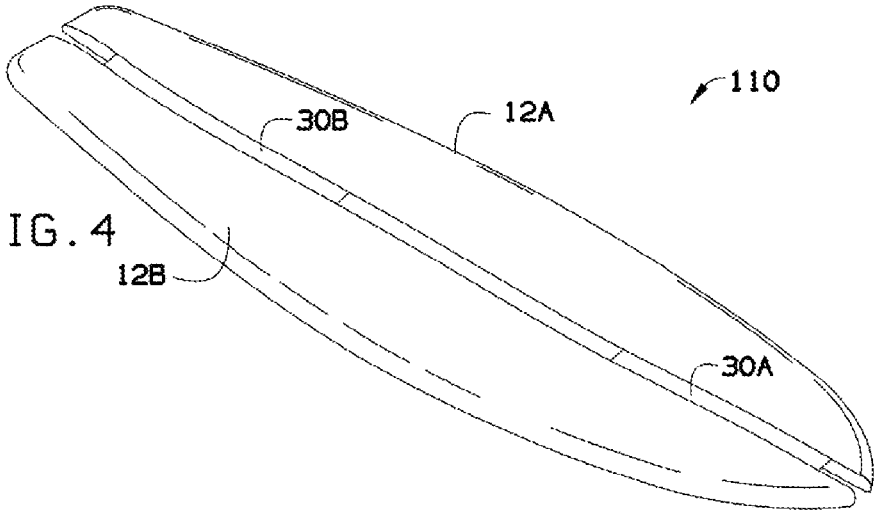
FIG. 4 is a perspective view of the inflatable two hull split embodiment (connected).
Figure 5:
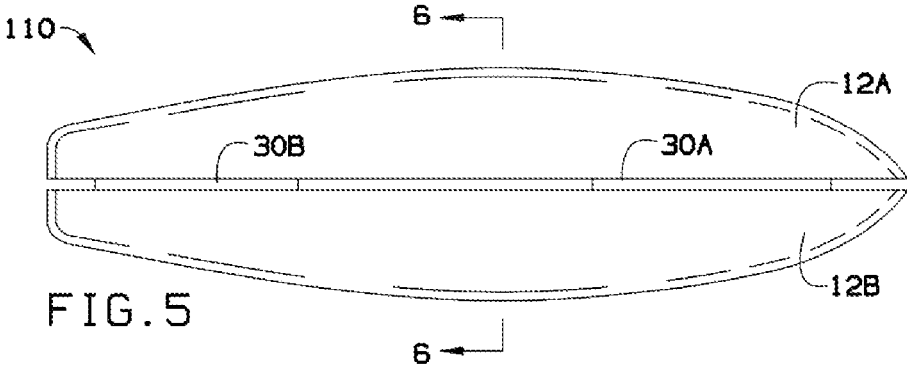
FIG. 5 is a top view of the inflatable two hull split embodiment (connected).
Figure 6:
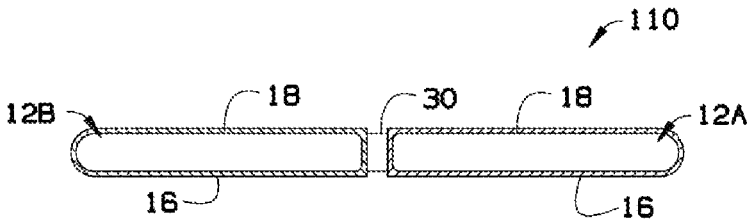
FIG. 6 is a top view of the inflatable two hull split embodiment (connected) along line 6-6 in FIG. 5.

FIG. 4, FIG. 5 and FIG. 6 refer to two hull split embodiment 110. Two hull split embodiment 110 comprises first board section 12A mechanically coupled to first air bladder 30A and second air bladder 30B. First air bladder 30A and second air bladder 30B are further mechanically coupled to second board section 12B. Air bladders 30A and 30B can be deflated to free up the two board sections 12. Of course, there can be any number of chambers which could be inflatable, foam or hard plastic.

Unlike air bladder 14, air bladder 30 need not be rigidly inflated and the flexibility from it not being rigidly inflated allows for greater movement of first board section 12A away from second board section 12B. This construction can be useful for shallow waters that are flat, calm or slightly rough where a user needs greater flexibility to transfer weight from one foot to the other without capsizing two hull split embodiment 110.

Figure 7:
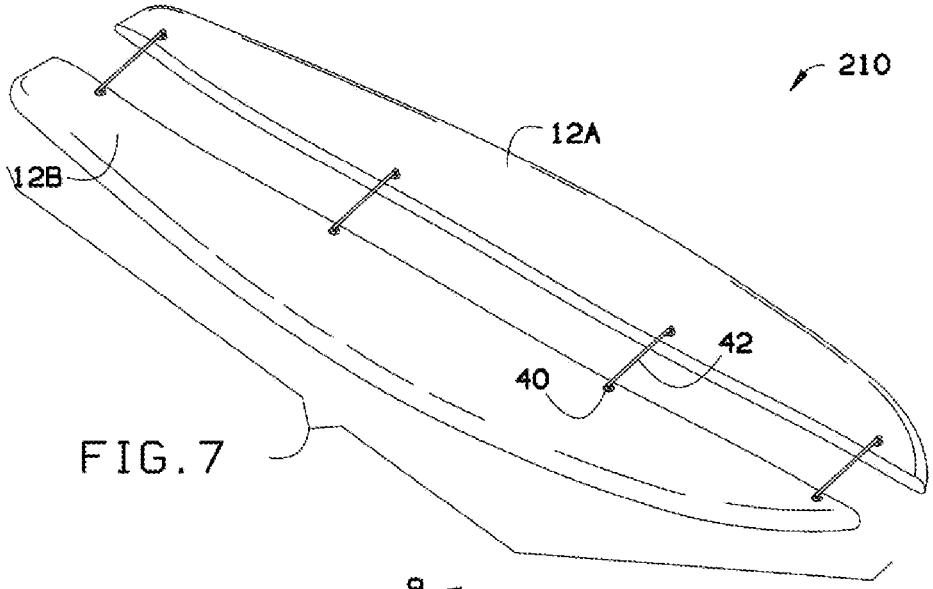
FIG. 7 is a perspective view of the two hull tethered embodiment.
Figure 8:
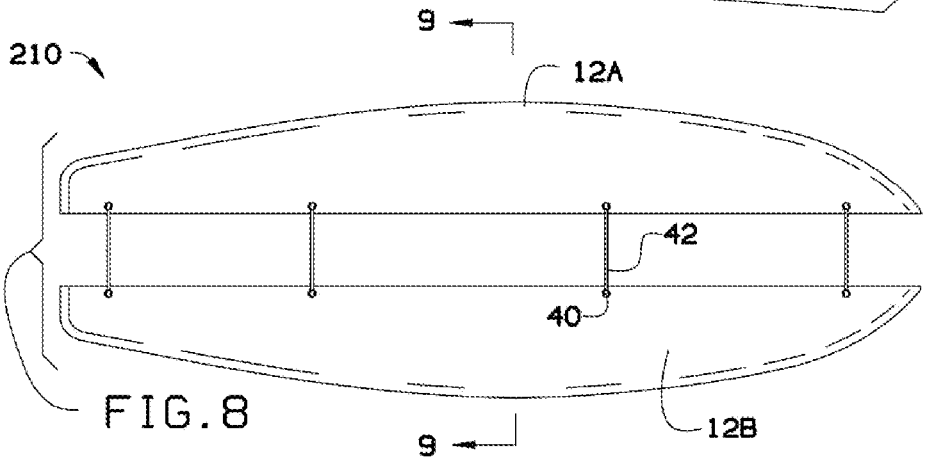
FIG. 8 is a top view of the two hull tethered embodiment.
Figure 9:
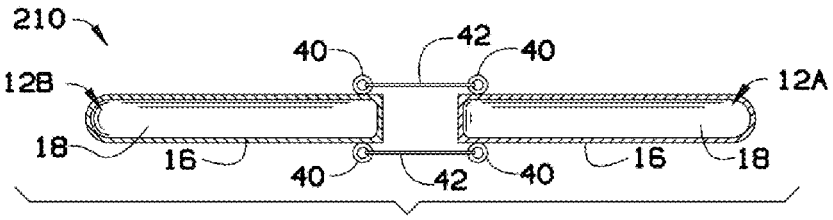
FIG. 9 is a top view of the two hull tethered embodiment along line 9-9 in FIG. 8.

FIG. 7, FIG. 8 and FIG. 9 refer to two hull tethered embodiment 210. Two hull tethered embodiment 210 comprises first board section 12A mechanically coupled to a first plurality of fasteners 40. Each fastener 40 is attached to tether 42. Through tethers 42, the first plurality of fasteners 40 is mechanically coupled to a second plurality of fasteners 40. The second plurality of fasteners are mechanically coupled to second board section 12B.

Unlike air bladder 14 and air bladder 30, tethers 42 can have tension between the fasteners 40 adjusted to meet the needs of the user. This can be applied to rougher waters where one foot may need to move quickly away from the other foot in order to maintain stability.

Figure 10:
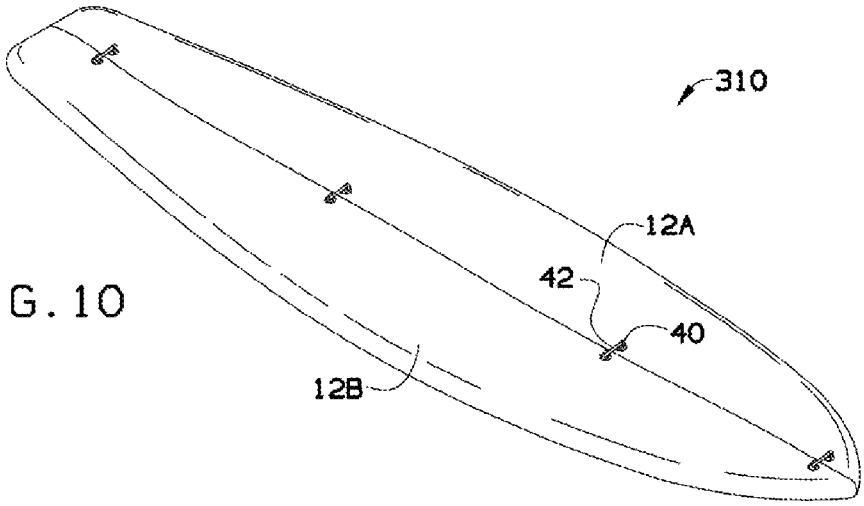
FIG. 10 is a perspective view of the tightly two hull tethered embodiment.
Figure 11:
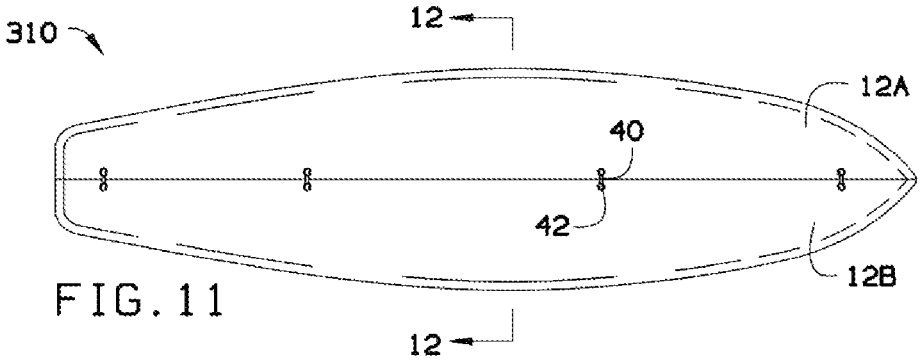
FIG. 11 is a top view of the tightly two hull tethered embodiment.
Figure 12:
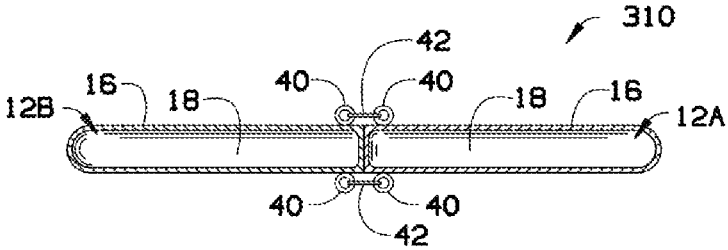
FIG. 12 is a top view of the tightly two hull tethered embodiment along line 12-12 in FIG. 11.

FIG. 10, FIG. 11 and FIG. 12 refer to tightly two hull tethered embodiment 310. Two hull tethered embodiment 310 comprises first board section 12A mechanically coupled to a first plurality of fasteners 40. Each fastener 40 is attached to tether 42. Through tethers 42, the first plurality of fasteners 40 is mechanically coupled to a second plurality of fasteners 40. The second plurality of fasteners are mechanically coupled to second board section 12B.

Similar to tri-chamber arrangement 10, two hull tethered embodiment 310 utilizes a connector that can hold first board section 12A close to second board section 12B. This can be used to maintain stability in calmer seas, but with a similar construction to two hull tethered embodiment 210. Of course, using tethers 42 between fasteners 40 is one of many ways to accomplish this detachable tethering.

Tether 42 can be any known connection. This includes rods, bungee cords, or anything else which is effective. Fasteners 40 can be attached to the top bottom or inside of board sections 12 depending on user preference.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A dual section paddle board configured to be stable in water which is shallow without fouling vegetation or hitting rocks, the dual section paddle board comprising;

two planar solid board sections that are symmetrical along a single edge of each section to increase stability while paddle boarding;

a connector joining the two planar solid board sections proximate one another permitting balance shifting that further increases stability;

wherein each planar solid board section is made from a buoyant material in order to maintain buoyancy;

wherein the connector is an at least one air bladder affixed to the buoyant material of each board section configured to move forward and backward about the air bladder depending on the amount of air in the air bladder.

2. The dual section paddle board of claim 1, wherein the air bladder is filled with compressed air making it rigid.

3. The dual section paddle board of claim 1, wherein the at least one air bladder is at least two air bladders affixed to the buoyant material of each board section to allow greater flexibility to transfer weight without capsizing the dual section paddle board.

4. A dual section paddle board configured to be stable in water which is shallow without fouling vegetation or hitting rocks, the dual section paddle board comprising;

two board planar solid sections that are symmetrical along a single edge of each section to increase stability while paddle boarding;

a connector joining the two planar solid board sections proximate one another permitting balance shifting that further increases stability;

wherein the connector is a plurality of fasteners mechanically coupled to a top surface on of each planar solid board section and attached to one another with a tether such that the two board planar solid sections are close together to provide stability in calm water;

wherein each board section is made from a buoyant material in order to maintain buoyancy;

wherein the connector further comprises a plurality of fasteners attached to a bottom surface on each planar solid board section; wherein each connector is attached to another connector with a tether such that the two board sections are close together to provide stability in calm water.

* * * * *